US005740716A

United States Patent [19]

Stilson

[11] Patent Number: 5,740,716

[45] Date of Patent: Apr. 21, 1998

[54] SYSTEM AND METHOD FOR SOUND SYNTHESIS USING A LENGTH-MODULATED DIGITAL DELAY LINE

[75] Inventor: Timothy S. Stilson, Mountain View, Calif.

[73] Assignee: The Board of Trustees of the Leland Stanford Juior University, Stanford, Calif.

[21] Appl. No.: 847,005

[22] Filed: May 1, 1997

Related U.S. Application Data

[60] Provisional application No. 60/017,208 May 9, 1996.

[51] Int. Cl.[6] ..... G10H 1/12; G10H 5/00

[52] U.S. Cl. ..... 84/661; 84/624; 84/629

[58] Field of Search ..... 84/607, 622, 659, 84/661, 624, 629

[56] References Cited

U.S. PATENT DOCUMENTS

| | | | |
|---|---|---|---|
| 4,622,877 | 11/1986 | Strong . | |
| 4,649,783 | 3/1987 | Strong et al. . | |
| 5,223,653 | 6/1993 | Kunimoto et al. | 84/659 X |
| 5,308,918 | 5/1994 | Yamauchi et al. | 84/622 |
| 5,496,964 | 3/1996 | Suzuki | 84/660 |
| 5,500,486 | 3/1996 | Smith, III | 84/622 |
| 5,578,780 | 11/1996 | Wachi | 84/659 |
| 5,641,931 | 6/1997 | Ogai et al. | 84/661 |

FOREIGN PATENT DOCUMENTS

| | | |
|---|---|---|
| PCT/US97/07771 | 8/1997 | WIPO . |

*Primary Examiner*—William M. Shoop, Jr.
*Assistant Examiner*—Jeffrey W. Donels
*Attorney, Agent, or Firm*—Gary S. Williams; Flehr Hohbach Test Albritton & Herbert LLP

[57] ABSTRACT

A sound synthesis system employs a variable-length delay line whose length is modulated at a frequency that is close to the fundamental frequency of the delay line. By modulating the length of the delay line at a frequency close to the fundamental frequency of the delay line, a new class of sounds is generated. A delay line length modulator produces a periodic modulation signal whose frequency is close to the fundamental frequency of the delay line. The length of the delay line is modulated in accordance with the modulation signal, thereby causing a variable pitch shifting effect in the waveform produced by the delay line structure. Since the length of the delay line is modulated at a frequency close to the average loop frequency, part of the waveform stored by the delay line is time-compressed and the other part is expanded. The waveform's shape changes smoothly so that the compressed part of the waveform is pitched-shifted upwards, and the expanded part is pitch-lowered. A simultaneous upward and downward shift in the spectrum of the waveform stored by the delay line results, generating musically intriguing sounds. In one embodiment, a regeneration filter introduces an instability into the delay line's feedback loop at a frequency of half the sampling rate. This introduces additional energy into the system which causes the waveform in the delay line to regenerate, thereby increasing the length of time that sound effects are generated after the introduction of an excitation pulse.

10 Claims, 4 Drawing Sheets

SYSTEM AND METHOD FOR SOUND SYNTHESIS USING A LENGTH-MODULATED DIGITAL DELAY LINE

This application claims the benefit of U.S. Provisional application Ser. No. 60/017,208, filed May 9, 1996.

The present invention relates generally to digital signal processing for generating music and other digitally sampled signals, and particularly to the use of length-modulated delay lines in digital signal processing systems and methods.

BACKGROUND OF THE INVENTION

Digital sound synthesis strives to simulate acoustical methods of sound production. The various synthesis techniques often utilize physical models of acoustical musical instruments. The physical models are based on a mathematical description of the behavior of the instrument. These models also serve as a basis from which new sounds can be created that would otherwise not be possible.

Referring to FIG. 1, there is shown an "extended Karplus-Strong delay line" 50 that includes a sampled data delay line 52, an interpolation filter 54, and a feedback path 56 that includes a loop filter and possibly a signal amplifier or gain element as well. The sampled data delay line 52 stores one digitally sampled data value for each sampling period. For instance, if the system in which the delay line 50 is used has a sampling rate $f_s$ of 44,100 Hz, then a new data sample is inserted into the delay line 44,100 times per second. If data is simply read from the delay line at specified reader position R, producing an output signal denoted as $U_R(n)$, then the delay line is said to be an integer length delay line, because the output signal $U_R(n)$ is delayed by an integer number of sampling periods from the time it was input into the delay line.

In the extended Karplus-Strong delay line structure 50, a linear interpolation is performed so as to produce a delay line having a fractional length of L+a0, where L is an integer and a0 is a fractional value between 0 and 1. L is the distance, in units of data sample positions, between the current input position W to the delay line and the filter's reader position, R−1, during the prior sample period:

$$L=R-1-W.$$

During each time period, n, the filter 54 reads a sampled data value $U_R(n)$ and outputs a filtered data value out(n) that is computed as follows:

$$out(n)=a0\times U_R(n)+(1-a0)\times U_R(n-1).$$

For example, if a0 is set equal to 0.5, the delay line has an effective length of L+0.5, and out(n) is equal to the average of the two data samples most recently read by the filter:

$$out(n)=0.5\times(U_R(n)+U_R(n-1).$$

Non-integer length delay lines such as the extended Karplus-Strong delay line 50 that use linear interpolation, or other FIR (finite impulse response filter) interpolation methods, can be varied smoothly in length by a control signal (e.g., a0 in the delay line shown in FIG. 1 ). However, linear interpolation filters of this type act as low pass filters, causing high pitched musical notes and the harmonics of lower musical notes to rapidly decay.

The delay line in the extended Karplus-Strong structure can be considered to be a recirculating wave table initialized to a set of random values. At each sampling period, a value is read out of the table and transmitted to a digital-to-analog converter (DAC), which converts the value into an audible sound. The value mad out of the table is also filtered and reinserted into the table in order to produce a variation in the sound rather than a purely periodic tone. In particular, the values read out of the table (i.e., delay line) are modified by a low pass filter that causes the signal values in the delay line to decay, eventually resulting in signal values very close to zero. The wave table may be reloaded with new values in order to generate a new sound.

The Karplus-Strong synthesis technique is often associated with the generation of the sounds of a plucked-string and drums. These sounds are audible for a short time and require reloading the wave table (i.e., delay line) repeatedly in order to generate the sound for a next note or other musical event.

It is an object of the present invention to digitally synthesize musically intriguing sounds and sounds that continue or regenerate for long periods of time.

It is another object of the present invention to provide a digital sound synthesis technique for generating musical sounds that are self-generating.

It is another object of the present invention to synthesize digital sounds as described above in a computationally efficient manner.

Other general and specific objects of this invention will be apparent and evident from the accompanying drawings and the following description.

SUMMARY OF THE INVENTION

The present invention pertains to a sound synthesis system employing a variable-length delay line whose length is modulated at a frequency that is close to the fundamental frequency of the delay line. By modulating the length of the delay line at a frequency close to the fundamental frequency of the delay line, a new class of sounds is generated.

A delay line length modulator produces a periodic modulation signal whose frequency is close to the fundamental frequency of a delay line. The length of the delay line is modulated in accordance with the modulation signal, thereby causing a variable pitch shifting effect in the waveform produced by the delay line structure.

Since the length of the delay line is modulated at a frequency close to the average loop frequency, part of the waveform stored by the delay line is time-compressed and the other part is expanded. When this occurs, the waveform's shape changes smoothly so that the compressed part of the waveform is pitched-shifted upwards, and the expanded part is pitch-lowered. A simultaneous upward and downward shift in the spectrum of the waveform stored by the delay line results, causing the generation of musically intriguing sounds.

In a second embodiment, an instability is introduced into the delay line structure's feedback loop at a frequency of half the sampling rate. This introduces additional energy into the system which causes the waveform in the delay line to regenerate, thereby increasing the length of time that sound effects are generated after the introduction of an excitation pulse. The regeneration circuit that introduces the instability is a one-pole filter (regeneration filter) whose gain is set so that during part of the waveform's cycle the filter has a large gain at a frequency of around half the sampling frequency. This causes the loop to become unstable during part of the modulation cycle under certain conditions, which adds energy to the waveform stored in the delay line. The pitch-shifting effect of the delay line length modulation described above causes the high frequency signals thus generated to be pushed down in frequency, thus regenerating the sound effects produced by the length modulated delay line.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

The present invention results from the realization that musically intriguing sounds can be produced when the length of the delay line of a Karplus-Strong delay line structure is length-modulated at a frequency that is close to the fundamental frequency of the delay line. The fundamental frequency of a delay line is the frequency associated with the delay line's nominal or average length, which imposes an associated period on the signal circulating in the loop.

Further, the introduction of an instability into the feedback loop at half the sampling frequency introduces additional energy into the network that results in a regeneration of sound effects for long periods of time. The present invention can also be used in systems that modulate the length of a delay line at a frequency that is a low multiple (e.g., 2, 3 or 4) or submultiple (e.g., ½, ⅓, or ¼) of the fundamental frequency of the delay line, or a ratio of small integers (e.g., ⅔, ¾, or ⅝) of the fundamental frequency of the delay line.

Figure 2:
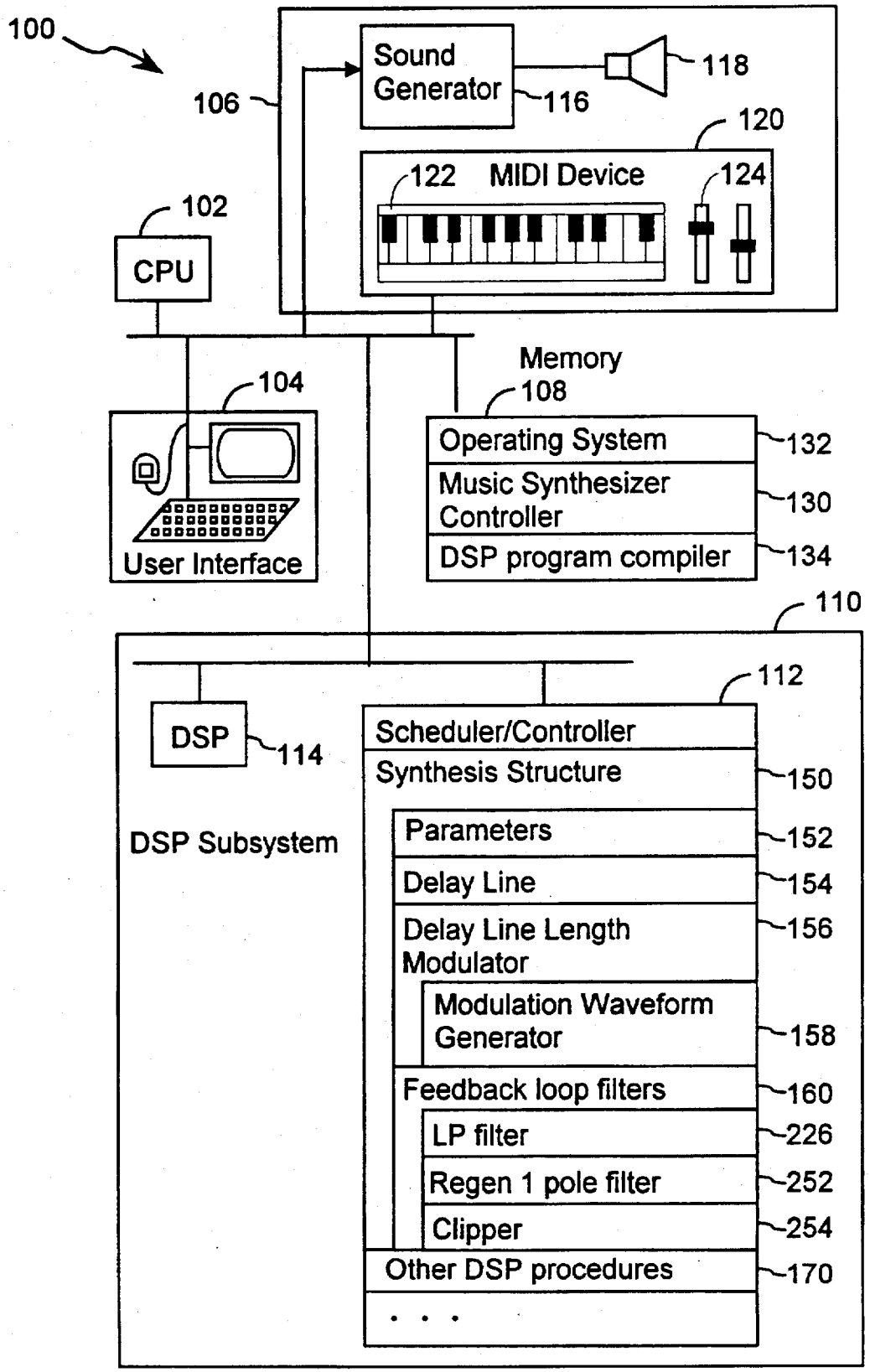
FIG. 2 is a block diagram of a real-time sound synthesis system incorporating a preferred embodiment of the present invention.

Referring to FIG. 2, there is shown a computer-based music synthesis system 100 having a host CPU 102, a computer user interface 104, a music interface 106, memory 108 (including fast random access memory and non-volatile memory such as disk storage), and a digital signal processor (DSP) subsystem 110.

The DSP subsystem 110 executes DSP programs downloaded by the host CPU 102 into the DSP subsystem's memory 112. The downloaded DSP programs typically are music synthesis programs that, when executed by the DSP subsystem's processor 114 (typically called a DSP), generate audio frequency signals. Those output signals constitute a stream of digital data values that are converted by a sound generator 116 (in the music interface) into analog electrical signals that are then converted into audible sound by a speaker 118. The sound generator 116 generally includes an analog to digital converter (ADO) as well as other circuitry not relevant here.

Control signals used by the DSP 114 when executing the DSP programs can originate from a MIDI device 120, such as a device having a keyboard 122 and one or more pitch blend wheels 124, of from a computer keyboard or pointing device in the computer user interface 106. Input signals from these input devices are typically pre-processed by the host CPU 104 through the execution of a music synthesizer control program 130 to produce control parameters that are then passed to the DSP subsystem 110.

In addition to the music synthesizer control program 130, the host CPU's memory 108 also will typically store an operating system 132, a DSP program compiler 134, as well as other software and data that are not directly relevant to the present discussion.

Figure 4:
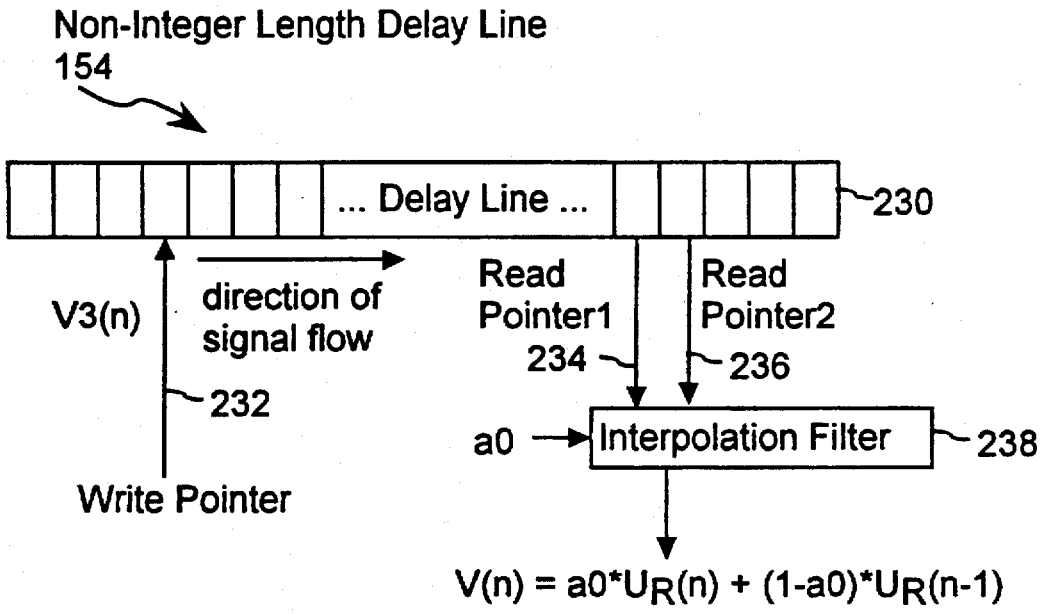
FIG. 4 is a schematic representation of a delay line used in the preferred embodiments of the present invention.

The memory 112 in the DSP subsystem 110 typically stores compiled DSP procedures 150, 170, and a scheduler or controller program 140 that schedules the execution the DSP procedures 150 by the DSP. The only one of those DSP procedures that is directly relevant to the present invention is the synthesis network structure 150, two versions of which are schematically represented in FIGS. 3 and 4.

While for ease of explanation the synthesis network structure 150 will be discussed as though it were a physical electronic circuit, it is in fact generally implemented as a DSP program or procedure. Actual music synthesis systems using the present invention may use a plurality of the synthesis network structures 150 so as to generate a stereo effect, or more generally, to generate multiple voices.

Figure 3:
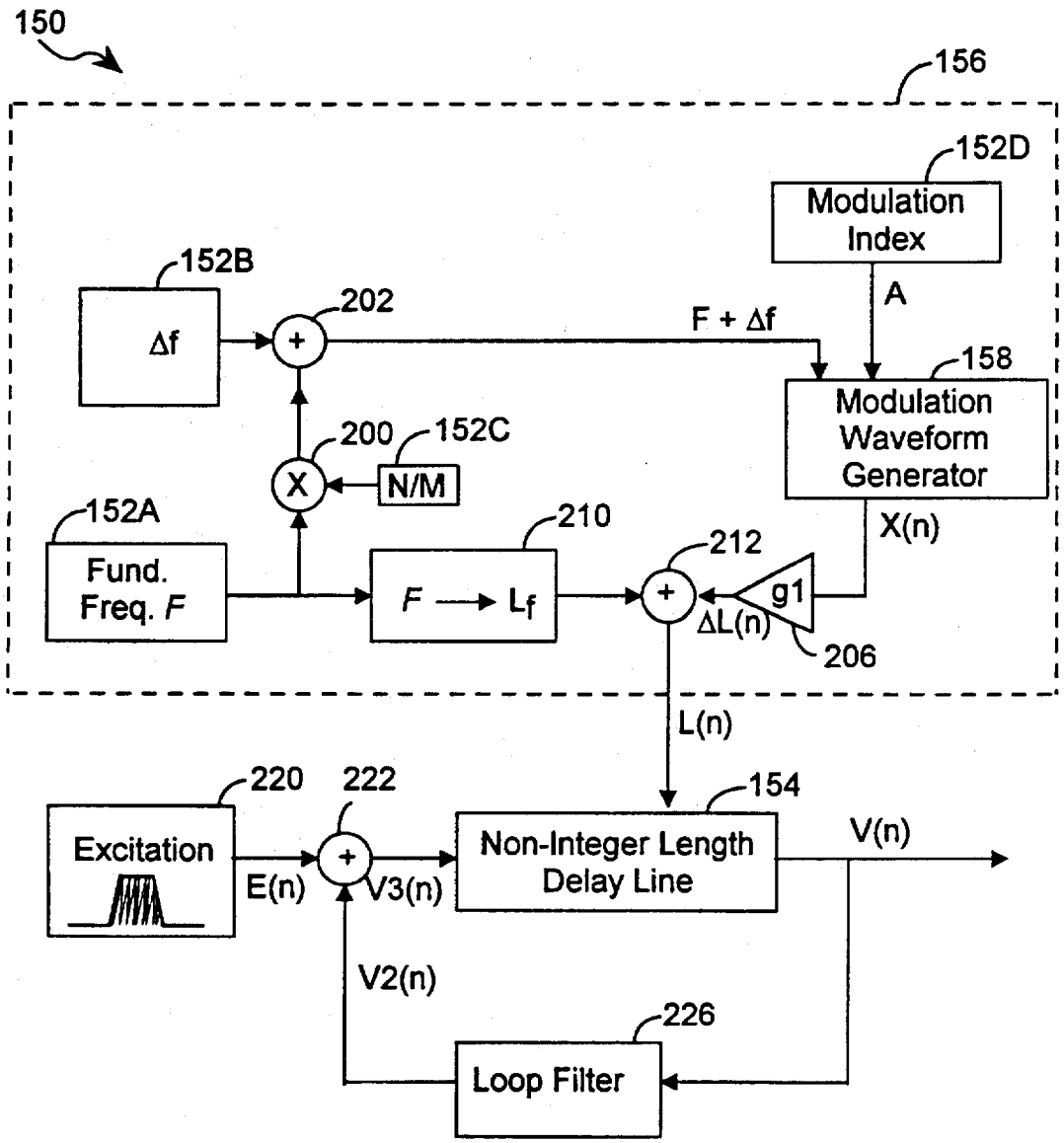
FIG. 3 is a schematic representation of a sound synthesis network in a first preferred embodiment of the present invention.

Referring to FIGS. 2 and 3, the synthesis network structure 150 includes a set of stored parameters 152, a delay line structure 154, a delay line length modulator 156, and a set of feedback loop filters 160. The stored parameters 152, which control operation of the synthesis network structure 150, include a fundamental frequency parameter 152A denoted as F, and frequency differential parameter 152B denoted as Δf, a frequency multiplier 152C denoted as N/M, a modulation index 152D denoted as A, and a first scaling coefficient denoted as g1. The second preferred embodiment shown in FIG. 5 includes additional stored parameters: a regeneration modulation coefficient 152E denoted as B, a second scaling coefficient denoted as g2, and a low pass loop filter control parameter 152F sometimes denoted as μ. These stored parameters can be changed by the host computer either at the direction of the system's user, or automatically, such as by a procedure that slowly varies one or more of the stored parameters so as to create a variety of sounds.

All dynamically updated values in the synthesis network structure 150 are updated at the audio sampling rate, which in the preferred embodiment is 44,100 Hz. Thus, a new input value is stored in the delay line 44,100 times per second, the modulation waveform L(n) generated by the delay line length modulator 156 is updated 44,100 times per second, and so on. The index parameter "n" is used to indicate the current sample period. Thus, "L(n)" represents the current value of the modulation waveform, while "L(n−1)" represents the previous value of the modulation waveform. In other embodiments of the present invention other sampling rates could be used, such as 22,050 Hz or 16,000 Hz.

In addition to the modulation waveform, the set of data stored in the delay line 154 is considered to be a "waveform," and the dynamically changing data at various points in the delay line loop, including the output signal V(n), are each considered to be a waveform.

The delay line length modulator 156 includes a multiplier 200 that scales the fundamental frequency value F by a factor of N/M. The N/M parameter 152C is usually set to "1", but may also be assigned values such as small integers 2, 3, 4 and their inverses ½, ⅓, ¼, or any other ratio of small integers (e.g., ⅔, ¾, or ⅝). N and M are both integers that typically are each set not greater than 6 and not less than 1.

Unless otherwise mentioned, the remainder of this discussion will assume that N/M has been set equal to 1.

An adder 202 sums the output of the multiplier 200 with a differential frequency value Δf to produce a modulation frequency (N/M)·F+Δf that is then passed to a modulation waveform generator 158. The modulation waveform generator 158 preferably outputs a sinusoidal or other periodic waveform X(n) having a repetition frequency equal to the aforementioned modulation frequency (N/M)·F+Δf and an amplitude of A, which is the modulation index parameter 152D.

The fundamental frequency F is converted into a delay line length value $L_F$ by a conversion operation 210 that divides the sampling rate $f_s$ by the fundamental frequency F. This length value $L_F$, sometimes called the nominal delay line length, defines the average length of the delay line 154.

The modulation waveform X is then optionally scaled by a factor of g1 by a multiplication operation 206 to produce a length modulation value ΔL(n), and summed by adder 212 with the nominal delay line length $L_F$ to generate a current delay line length value L(n). The amplitude of the length modulation waveform L(n) should, in general, be less than the nominal length $L_F$ of the delay line, since negative delay line lengths are not meaningful.

Figure 1:
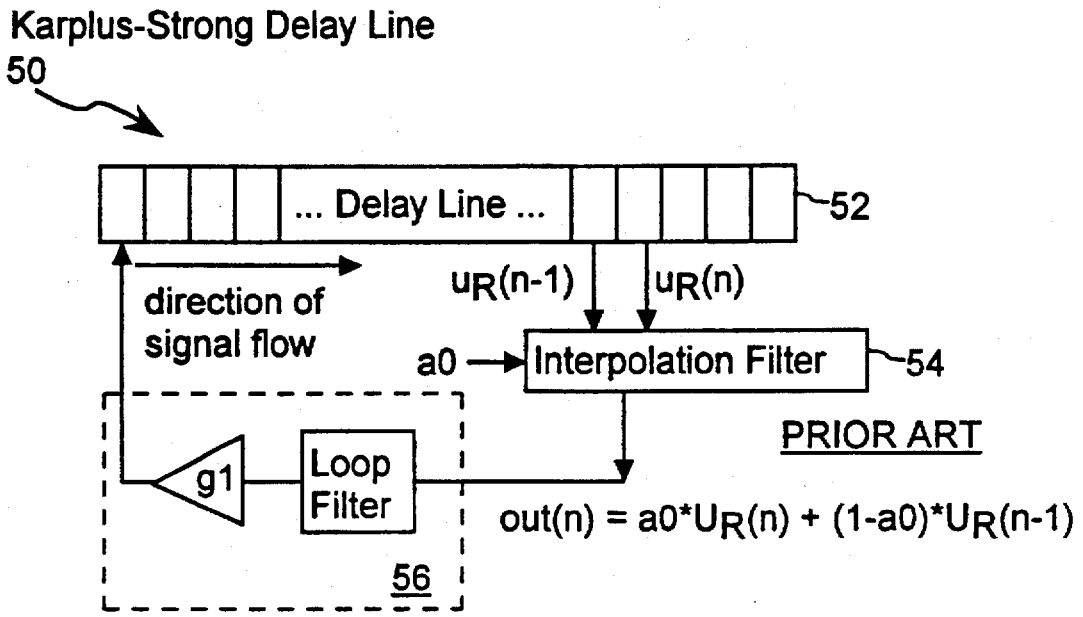
FIG. 1 is a schematic representation of a delay line with a linear interpolator filter.

The length of the delay line 154 is modulated in accordance with the value of L(n). That is, the output of the delay line is read using a read pointer that is positioned L(n) sample positions away from the delay line's write pointer (which is where new input values are written into the delay line 154). Because L(n) is generally a non-integer value, the output of the non-integer length delay line is generated using an interpolator (not shown), such as the FIR linear interpolator 54 shown in FIG. 1. The present invention can utilize any delay line interpolator suitable for generating signals representative of signals delays by a non-integral number of sample periods.

The output of the delay line V(n) is filtered by a low pass loop filter 226 and the resulting signal V2(n) is then combined with an excitation signal 220 E(n) before being written back into the delay line 154. The excitation signal 220 is usually set to zero, except when the user of the system decides to initiate generation of a sound effect by the synthesis network structure, at which time a shaped pulse of noise is output by the excitation source for storage in the delay line 154. The function of the excitation signal 220 E(n) is to fill the delay line 154, or at least a portion of the delay line, with a random signal waveform, and thus the excitation signal can be very short in duration. In other embodiments the excitation signal need not be noise, and instead could be any random or structured signal the system's user selects.

The output signal V(n) is transmitted to the sound generator 116, which converts the digital waveform V(n) into analog electrical signals that are then converted into audible sound by speaker 118. Alternately, the waveform V(n) may be stored in a memory device for playback, or further signal processing, at a later time.

The synthesis network structure 150 generates musically intriguing sounds (i.e., waveforms) not previously produced. In this embodiment, the musically intriguing sounds or waveforms are generated by modulating the length of the delay line at a frequency that is close to the fundamental frequency of the loop. By varying the length of the delay line in this fashion, different portions of the waveform will be repeatedly altered in a like manner and independently of each other. This results in a simultaneous upward and downward shift of the spectrum of the sound producing a distinctive class of sounds and frequency shifting behaviors.

FIG. 4 illustrates the implementation of the variable, non-integer length delay line 154 of the present invention. The delay line 154 includes a table or buffer 230 having a fixed number of entries that is used as a circular buffer. There is a write pointer 232 that defines the position in the delay line buffer 230 where data V3(n) is written back into the delay line. There are also two read pointers 234, 236 that define where data is read from the delay line buffer 230. At each sampling time, n, the read pointers 234, 236 are positioned relative to the write pointer 232 according to the current value of the modulated delay line length L(n), where the first read pointer's position corresponds to the value of L(n) rounded down to the closest lower integer and the second read pointer's position corresponds to the value of L(n) rounded up to the closest higher integer. An interpolation filter 238 interpolates the values read from the delay line buffer 230 to generate an interpolated value V(n) that represents data delayed from the delay line input by L(n) time sample periods. The interpolation filter control parameter a0 represents the fractional part of the current delay line length L(n).

Referring again to FIG. 3, the low pass loop filter 226 can be a two-point averaging filter which averages two successive samples in accordance with the following mathematical relation:

$$V2(n)=(0.5+\mu)\cdot V(n)+(0.5-\mu)\cdot V(n-1).$$

When μ is equal to 0, $$V2(n)=0.5\ (V(n)+V(n-1))$$

The loop filter attenuates high frequencies components of the waveform in the delay line 154. The cutoff frequency of the low pass filter in the preferred embodiment is half the sampling rate, or 22,050 Hz. The loop filter causes the waveform in the delay line to eventually be attenuated to a constant value or silence. It should be noted that the loop filter 226 is not constrained to using a filter coefficient of 0.5, nor is it constrained to the particular type of filter used in the preferred embodiments. Although, the low pass filter's coefficient is usually kept constant, it can be varied to produce a change in the sound under user control.

The length L(n) of the delay line 154 is a waveform whose frequency and amplitude are determined by control input values for the fundamental frequency F of the loop, the frequency differential Δf, and the modulation index A. The fundamental frequency F is a user-defined input and can be controlled by the MIDI device 120 through a MIDI keyboard 122 or pitch-bend wheel 124. The synthesizer network structure 150 of the present invention typically produces its most interesting effects when the fundamental frequency F is fairly low, generally between 10 Hz and 110 Hz, and most preferably between 10 Hz and 55 Hz. The frequency differential Δf is an offset from the fundamental frequency. The frequency differential Δf is typically within the range −10 Hz to 10 Hz, and is most preferably between −1 Hz and +1 Hz. Typically the frequency differential is not zero, or is not left at a value of zero for long periods of time.

In one preferred embodiment, the modulation waveform generator 158 outputs a sine wave in accordance with the following mathematical relation:

$$X(n)=\sin\left(\frac{(N/M)F+\Delta f}{f_s}(n)\right)$$

Although, the preferred modulating waveform is a sine wave, the present invention is not limited to this type of waveform.

The length modulation of the delay line 154 causes a pitch shifting effect in the waveform stored by the delay line. Since the length of the delay line is modulated at a frequency close to the loop frequency, part of the waveform is time-compressed (or shortened) and the other part is expanded (or lengthened). When this occurs, the stored waveform's shape changes smoothly so that the compressed part of the wave is pitched-shifted upwards, and the expanded part appears is pitch-lowered. This results in a simultaneous upward and downward shift in the spectrum of the sound resulting in the generation of intriguing sounds.

This pitch-shifting effect is controlled by the frequency differential Δf. The frequency differential causes a slow variation in the waveform in order to prevent the sound from becoming static and boring. The difference between the fundamental and length modulation frequencies causes the regions of the delay line waveform that are operated on by the different aspects of the modulation to slowly shift in time, causing the sound associated with the delay line waveform to evolve over time. The regions of the delay line waveform shift back and forth from compression to expansion portions of the modulation effect. The continual shifting of the regions of the delay line waveform that are compressed and expanded helps to avoid extreme compression and extreme expansion of any portion of the waveform, thereby allowing the sound associated with the delay line waveform to continue much longer than it would otherwise. For example, if the waveform were compressed too far, that portion of the waveform would be quickly attenuated by the loop filter 226.

Figure 5:
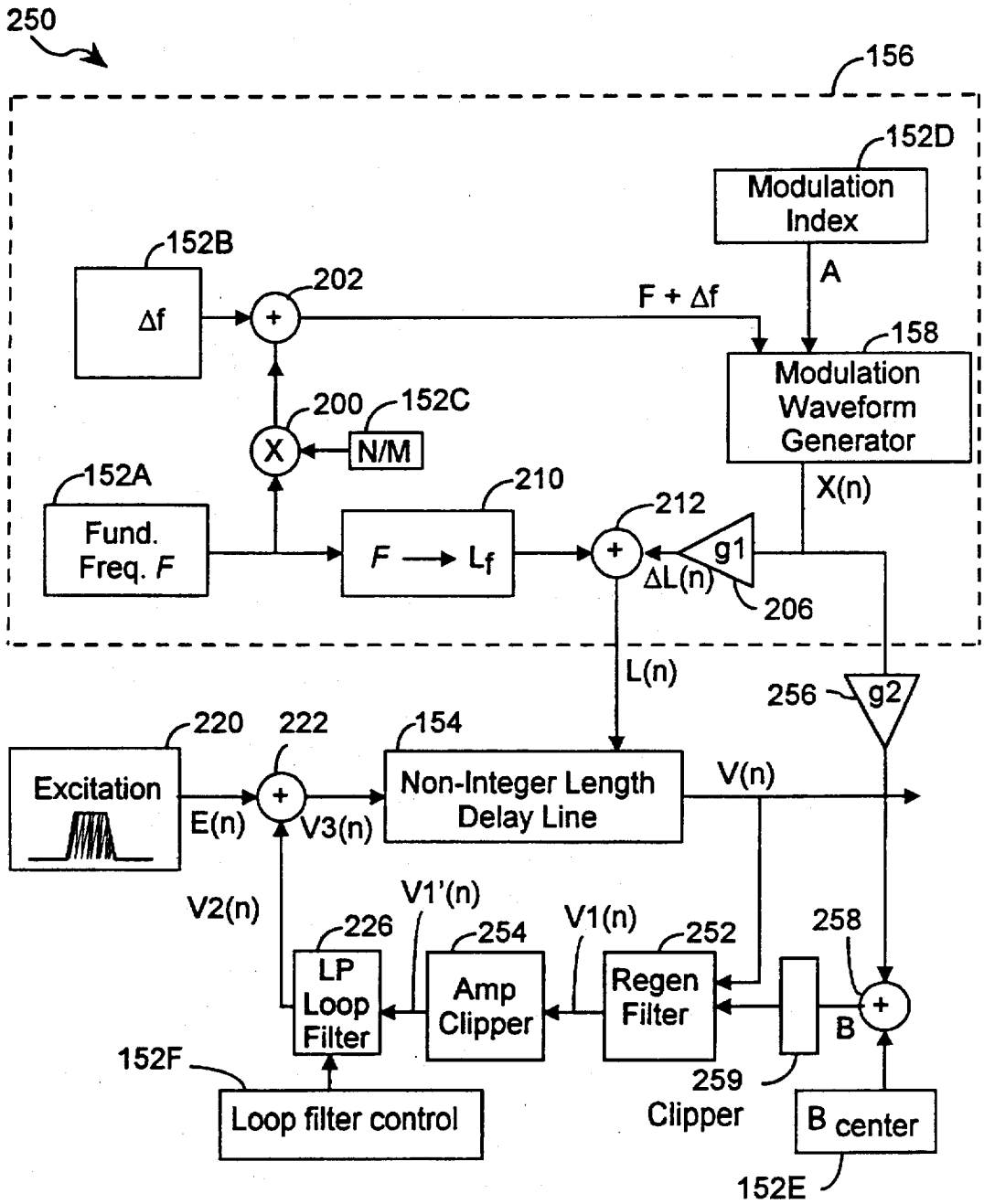
FIG. 5 is a schematic representation of a sound synthesis network in a second preferred embodiment of the present invention.

Referring to FIG. 5, in a second preferred embodiment of the present invention a second synthesis network structure 250 uses the same delay line length modulator 156 to modulate the length of a delay line 154 as in the first preferred embodiment. However, the second synthesis network structure 250 includes a regeneration filter 252, an amplitude clipper 254, and a loop filter 226 in the delay line's feedback loop. The purpose of the regeneration filter 252 is to cause regeneration of the waveform in the delay line and continuation of the sound effects produced by the synthesis network structure for longer periods of time than would otherwise be the case.

The regeneration filter 252 in the preferred embodiment is a variable one-pole filter whose gain is set so that during part of the waveform's cycle the filter has a large gain around half the sampling frequency. This causes the delay line loop to become momentarily unstable when high frequency signals produced by the delay line length modulation are processed by the regeneration filter. This instability adds energy to the waveform in the delay line in the high frequency portion of the spectrum, at frequencies near half the audio sampling rate. The pitch-shifting effect of the delay line length modulation, as described above, then causes the high frequencies signals generated by the instability to be pushed down in frequency, resulting in regeneration of the delay line length modulation sound effect. The regeneration filter allows the sound to continue for quite a long time and adds new dimensions to the effect.

The regeneration filter 252 is a variable one-pole filter whose pole location is modulated by the same signal that modulates the delay line with the addition of a different amplitude, $A \cdot g_2$, and offset, $b_{center}$, as follows:

$$\text{pole} = b_{center} + A \times g2 \times \sin\left(\frac{(N/M)F + \Delta f}{f_s}(n)\right)$$

Preferably, the pole location is a real number within the range [−1, +1] and $b_{center}$=0.731.

The pole value is generated using a multiplier 256 for scaling the modulation waveform X(n) by a scalar g2, and an adder 258 that adds the scaled modulation waveform to the offset value $b_{center}$. To ensure that the pole location is within the range [−1, +1], the output of adder 258 is clipped by an amplitude clipper 259, which revises values below −1 to a clipped value of −1 and values above 1 to a clipped value of 1.

The regeneration filter's 252 difference equation is as follows $$V1(n) = (B+1)V(n) - B\ V1(n-1)$$

where B=−1·pole. The regeneration filters output signal V1(n) is clipped to an amplitude of ±1.0 by amplitude clipper 254 that functions in accordance with the following mathematical relation:

$$\begin{aligned} \text{Clip}\,(V1(n)) &= V1(n) \text{ for } |V1(n)| \leqq 1 \\ &= \text{sign}(V(n)) \text{ for } |V1(n)| > 1. \end{aligned}$$

The loop filter 226 is a two-point average sampling filter whose operation is defined by the following mathematical relation:

$$V2(n) = (0.5+\mu)\cdot V1'(n) + (0.5-\mu)\cdot V1'(n-1)$$

The loop filter's coefficients are selected to preserve the high frequency signals generated by the regeneration filter. The value of μ, the loop filter control 152F, can be a user-defined input that is used to adjust the amount of regeneration. A value of μ=0 produces no regeneration since the loop filter has full attenuation at the same frequency that the regeneration filter 252 has high gain. Values of p that lie within the range 0.5>|μ|>0 produce some amount of regeneration.

The regeneration effect occurs when the loop gain at a particular frequency is greater than unity. In the present invention this occurs at a frequency that is half the sampling rate. The amount of regeneration caused by the regeneration filter is controlled in by the modulation index A and the loop filter coefficient μ. The modulation index A controls the gain of the regeneration filter 252 and the loop filter coefficient μ controls the gain of the loop filter 226. The loop gain at a particular frequency f is the product of the gains of the regeneration filter and the loop filter at the frequency f (i.e., loop_gain (f)=loop_filter_gain(f)×regeneration_filter_gain(f)). When the loop gain for a certain frequency range is greater than one, the loop is unstable at those frequencies, which causes the insertion of energy or signals into the delay line at the those frequencies. When the loop gain is less than one for a particular frequency range, the signals in that frequency range are attenuated.

The product of the modulation index A and the second scaling coefficient g2 controls the gain of the regeneration filter as well as the frequency range over which the regeneration filter's high gain is applied. More particularly, the product of the modulation index A and the second scaling coefficient g2 controls the value of B, the coefficient of the regeneration filter's difference equation. The gain of the filter at half the sampling rate is (B+1)/(B−1). The modulation waveform X(n) controls the phase of B during the modulation cycle and the modulation index determines how close B gets to 1.0. When B reaches or approaches a value of 1.0, the gain of the regeneration filter is very large. If the gain of the loop filter 226 at half the sampling rate is not equal to zero (i.e., p is not equal to 0), then the loop gain will typically be greater than unity. Further, for large values of the modulation index, the gain of the regeneration filter will be greater than unity for a larger portion of the cycle, thereby increasing the amount of signal regeneration.

The present invention is not constrained to a regeneration filter as described above. Regeneration can also be implemented by replacing the variable filter with any modulatable filter or subsystem that presents a loop gain much larger than unity for some frequency range for part of the modulation cycle. Preferably, a loop gain larger than unity is used for high frequency ranges and not for the full cycle. The regeneration can be controlled by controlling the amount by which loop gain exceeds unity and/or by controlling the position of the loop-filter poles.

The present invention is not constrained to a two-point average sampling filter 226 as described above. Other filters can be used depending on the amount of regeneration preferred. For the case of no regeneration, a low pass filter that completely suppresses signals at the frequencies at which the regeneration filter has its highest gain can be used. Where regeneration is desired, a loop filter that does not completely suppress signals at these frequencies is required.

Various modifications can be made to the present invention to enhance its functionality. For instance, multiple copies of either of the sound synthesis systems described above can be run in parallel. The parallel synthesis systems are preferably operated with identical control inputs except for one parameter (or a small number thereof) that can be varied slightly in order to cause the sounds to vary thereby producing interesting stereo or multichannel effects.

Another modification of the aforementioned embodiments is an automated version of the synthesis system where the various control inputs are controlled by a low-frequency oscillator that alters the values of the control inputs in a desired manner. Preferably, the values of the control inputs can be varied at a rate on the order of 1/50 Hz.

In another embodiment, the pole position for the regeneration filter may be modulated by a second, different modulation signal than the delay line, where the second modulation signal has either a different waveform than the other modulation signal, and/or has a repetition frequency that is a different one of the N/M multiples of the fundamental frequency.

In yet another embodiment, the regeneration filter is replaced, or supplemented, with a nonlinear filter, such as a filter that filters an input single X in accordance with a non-linear expression such as $1+aX^2$, or $1+a\cdot\cos(X)$, or $1+\cos(aX)$, where "a" is a control parameter that is generated by the modulation waveform generator 158 or a second modulation waveform generator that generates a signal whose waveform has a repetition rate that is related to the fundamental frequency by a ratio N/M of small integers. Such nonlinear filters perform a frequency modification of the signal being filtered.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. An audio signal generation system, comprising:

a variable length, sampled data delay line having a multiplicity of integer positions from which data can be read; said delay line having a defined nominal length and an associated fundamental frequency;

an interpolation filter for reading data from the delay line at any specified non-integer position, the data read from the delay line by the interpolation filter representing an audio signal generated by the system;

an excitation source for inserting excitation data into said delay line;

a length modulation network for modulating the position at which data is read from the delay line by said interpolation filter, said length modulation network modulating said position at a frequency that is a function of said fundamental frequency; and a loop filter coupled to the interpolation filter for filtering said data read from the delay line by said interpolation filter and for writing the filtered data into said delay line.

2. The audio signal generation system of claim 1, said length modulation network including a modulation signal generator for generating a periodic signal representing said position at which data is read from the delay line by said interpolation filter, said periodic signal having a frequency of $(N/M)\cdot F+\Delta f$, where N and M are integers where $1\leqq N\leqq 6$ and $1\leqq M\leqq 6$, F is said fundamental frequency, and $\Delta f$ is a differential frequency having a value between −10 Hz and +10 Hz.

3. The audio signal generation system of claim 2, said periodic signal generated by said modulation signal generator is a sinusoidal signal.

4. The audio signal generation system of claim 1, said loop filter including a regeneration filter that is unstable in a defined frequency range at least some of the time, said regeneration filter adding energy to said filtered signal.

5. The audio signal generation system of claim 1, said data stored in said delay line representing a waveform;

said length modulation network generating a filter modulation signal that is synchronized with said modulated position; and said loop filter including a regeneration filter that is unstable in a defined frequency range, wherein said regeneration filter includes a pole whose position is modulated by said filter modulation signal, whereby said regeneration filter filters said waveform in said delay line in a time varying manner.

6. A method of generating audio signals, comprising the steps of:

storing data in a variable length, sampled data delay line having a multiplicity of integer positions from which data can be read; said delay line having a defined nominal length and an associated fundamental frequency;

reading data from the delay line at any specified non-integer position using an interpolation filter, the data read from the delay line by the interpolation filter representing an audio signal generated by the method;

inserting excitation data into said delay line;

modulating the position at which data is read from the delay line by said interpolation filter, wherein said modulating is performed at a frequency that is a function of said fundamental frequency; and filtering said data read from the delay line by said interpolation filter and writing the filtered data into said delay line.

7. The method of claim 6, said modulating step including generating a periodic signal representing said position at which data is read from the delay line by said interpolation filter, said periodic signal having a frequency of $(N/M)\cdot F+\Delta f$, where N and M are integers where $1 \leqq N \leqq 6$ and $1 \leqq M \leqq 6$, F is said fundamental frequency, and $\Delta f$ is a differential frequency having a value between −10 Hz and +10 Hz.

8. The method of claim 7, wherein said periodic signal is a sinusoidal signal.

9. The method of claim 6, said filtering step including filtering said data read from the delay line with a filter that is unstable in a defined frequency range at least some of the time so as to add energy to said filtered signal.

10. The method of claim 6, said data stored in said delay line representing a waveform;

said modulating step generating a filter modulation signal that is synchronized with said modulated position; and said filtering step including filtering said data read from the delay line with a filter having a pole whose position is modulated by said filter modulation signal.

* * * * *